US007641363B1

(12) United States Patent
Chang et al.

(10) Patent No.: US 7,641,363 B1
(45) **Date of Patent: *Jan. 5, 2010**

(54) LED STREETLIGHT STRUCTURE

(75) Inventors: Kun-Jung Chang, Kaohsiung County (TW); Ching-Yuan Juan, Kaohsiung County (TW); Kuo-Chun Lin, Kaohsiung County (TW); Ching-Huang Juan, Kaohsiung County (TW)

(73) Assignee: Li-Hong Technological Co., Ltd., Kaohsiung County (TW)

( * ) Notice: Subject to any disclaimer, the term of this patent is extended or adjusted under 35 U.S.C. 154(b) by 43 days.

This patent is subject to a terminal disclaimer.

(21) Appl. No.: 12/139,843

(22) Filed: Jun. 16, 2008

(51) Int. Cl.
*F21V 29/00* (2006.01)

(52) U.S. Cl. ..... 362/294; 362/374; 362/345

(58) Field of Classification Search ..... 362/294, 362/373, 580, 480, 547, 218, 345, 431, 800
See application file for complete search history.

(56) References Cited

U.S. PATENT DOCUMENTS 7,347,706 B1 * 3/2008 Wu et al. ..... 439/320
2007/0070628 A1 * 3/2007 Chen ..... 362/249
2008/0232118 A1 * 9/2008 Liu ..... 362/373

* cited by examiner

*Primary Examiner*—Gunyoung T Lee
(74) *Attorney, Agent, or Firm*—Muncy, Geissler, Olds & Lowe, PLLC

(57) ABSTRACT

The present invention discloses an LED streetlight structure, which comprises: a heat-conduction pipe frame, an upper casing, a lower casing, a light concentration plate, and a transparent cover. The upper and lower casings are made of a plastic material and pivotally coupled to each other. The heat-conduction pipe frame has a heat-dissipation seat with main heat-dissipation fins. Two stabilizer boxes with fins are respectively arranged at two sides of the heat-dissipation seat. Heat-dissipation lamp sets insert through the bottom of the heat-dissipation seat. The present invention installs the main heat-dissipation fins on heat-conduction pipe frame and installs the fins on the stabilizer boxes to increase heat-dissipation area. Further, an auxiliary heat-dissipation ventilation device is arranged above the heat-conduction pipe frame and made of aluminum, and aluminum itself benefits heat dissipation. Furthermore, air can be compulsively conducted to the main heat-dissipation fins, then can enhance the dissipation effect.

5 Claims, 6 Drawing Sheets

LED STREETLIGHT STRUCTURE

FIELD OF THE INVENTION

The present invention relates to an LED streetlight structure, particularly to a high brightness LED streetlight structure with an enhanced heat dissipation effect and a prolonged LED lamp lifetime.

BACKGROUND OF THE INVENTION

The conventional streetlight usually adopts high-brightness and high-power light emitting elements to achieve high brightness, and the heat is dissipated by the casing of the streetlight. However, the conventional technology has the following disadvantages:

1. As the conventional streetlight adopts high-brightness and high-power light emitting elements, it has a very amazing power consumption. In such an age that energy is being exhausted, the conventional streetlight is not the best choice.

2. Because of high power consumption, the conventional streetlight generates so much heat that the casing thereof is hard to dissipate heat effectively, which may overheat the casing and burn the light emitting elements.

As the conventional casing is hard to dissipate the heat generated by the light emitting elements of the conventional streetlight, the Inventor has proposed an "Improved Heat-Dissipation Structure" in an U.S. patent Ser. No. 12/042,634, which adopts an aluminum casing with a superior heat-dissipation performance to dissipate the heat generated by a streetlight.

SUMMARY OF THE INVENTION

The present invention is to solve the problems of the above-mentioned US patent "Improved Heat-Dissipation Structure", wherein the high-power and large-size light emitting elements adopt upper and lower casings made of aluminum but not plastic. The present invention proposes an LED (Light Emitting Diode) streetlight structure outperforming the prior art to solve the above-mentioned problems. The present invention installs main heat-dissipation fins on a heat-conduction pipe frame and installs fins on stabilizer boxes to increase heat-dissipation area. Further, an auxiliary heat-dissipation ventilation device is arranged above the heat-conduction pipe frame and made of aluminum, and aluminum itself benefits heat dissipation. Furthermore, air can be compulsively conducted to the main heat-dissipation fins of the heat-conduction pipe frame. Thereby, the present invention can enhance the heat dissipation effect and prolong the lifetime of LED lamps.

The present invention proposes an LED streetlight structure, which comprises: a heat-conduction pipe frame, an upper casing, a lower casing, a light concentration plate, and a transparent cover. The upper and lower casings are pivotally coupled to each other. The upper and lower casings are made of a plastic material to reduce the weight of a streetlight. However, the heat-dissipation area is thus reduced. Therefore, the heat-conduction pipe frame has a heat-dissipation seat with main heat-dissipation fins; two stabilizer boxes with fins are respectively arranged at two sides of the heat-dissipation seat; an auxiliary heat-dissipation ventilation device is arranged above the heat-conduction pipe frame. Thereby, the heat-dissipation area is increased. Besides, heat-dissipation lamp sets insert through the bottom of the heat-dissipation seat.

The present invention has the advantage: the present invention installs an auxiliary heat-dissipation ventilation device above the heat-conduction pipe frame on the upper casing to promote the heat dissipation function of the high-power and large-size LED streetlight (over 30 W).

DETAILED DESCRIPTION OF THE PREFERRED EMBODIMENTS

Figure 1:
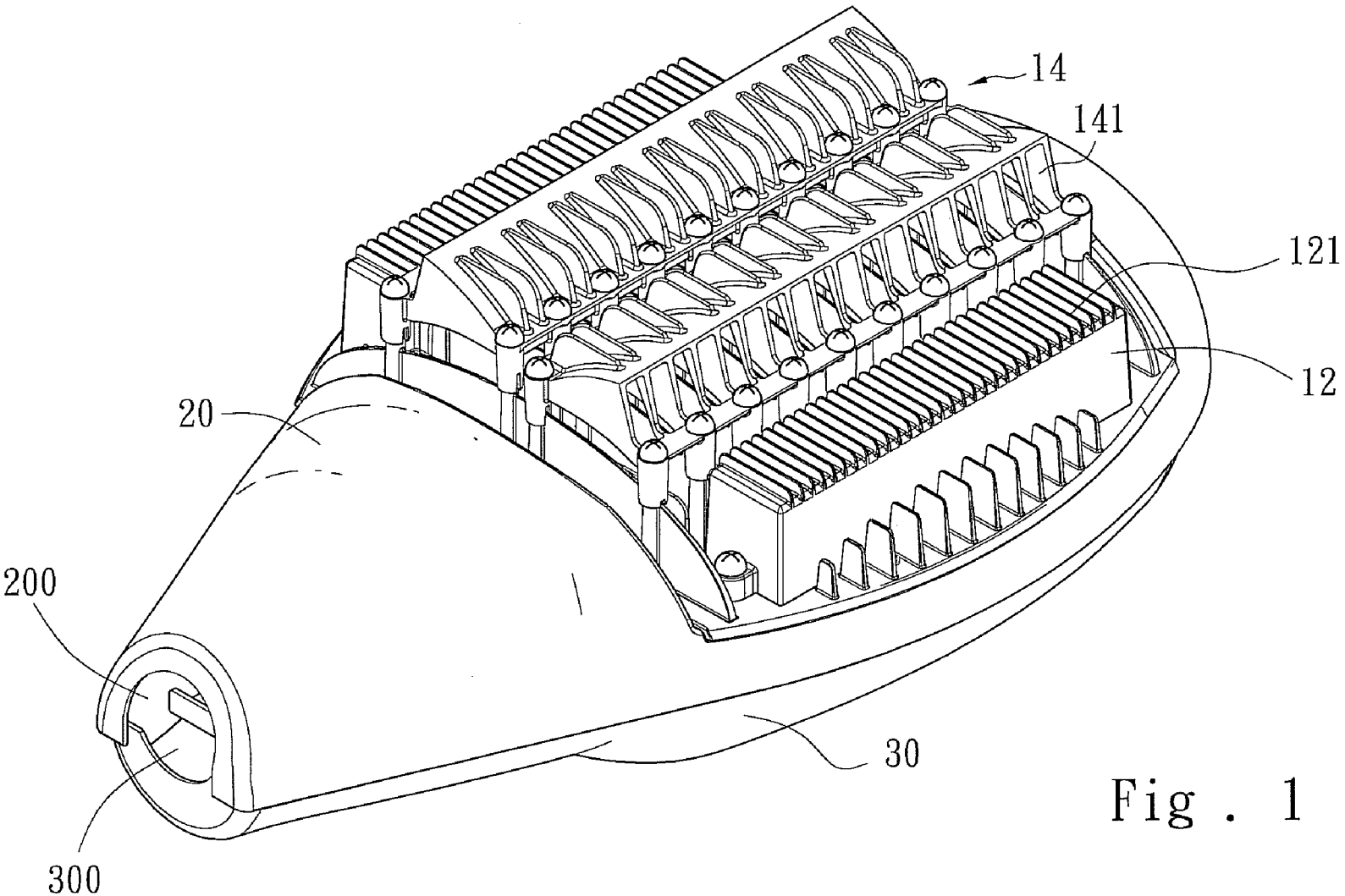
FIG. 1 is a perspective view of an LED streetlight structure according to the present invention.

Refer to FIG. 1, FIG. 2, FIG. 3 and FIG. 6. The present invention proposes an LED (Light Emitting Diode) streetlight structure, which comprises: a heat-conduction pipe frame 10, an upper casing 20, a lower casing 30, a light concentration plate 40, and a transparent cover 50.

The heat-conduction pipe frame 10 has a heat-dissipation seat 11, two stabilizer boxes 12, a plurality of heat-dissipation lamp sets 13, and an auxiliary heat-dissipation ventilation device 14. The heat-dissipation seat 11 further comprises: a set of main heat-dissipation fins 111, and a plurality of sleeve rods 1110. Two interspaces 110 are arranged at two sides of the heat-dissipation seat 11. Two stabilizer boxes 12 are respectively secured in the interspaces 110, and each stabilizer box 12 has a plurality of fins 121. The interspace 110 has a plurality of insertion holes 1100 and a plurality of insertion rods 1101. The heat-conduction pipes 131 of the heat-dissipation lamp sets 13 will insert into the insertion rods 1101. The heat-dissipation seat 11 also has a flange 112 thereround, and the flange 112 is to be fastened to a basin 21 of the upper casing 20. The auxiliary heat-dissipation ventilation device 14 is installed above the insertion rods 1101 of the heat-conduction pipe frame 10. The auxiliary heat-dissipation ventilation device 14 has a plurality of ventilation holes 141 at two sides thereof and a central heat-dissipation hole 142. The fins 121 on the top of the stabilizer box 12 enhance the heat dissipation of the stabilizer box 12. The bottom of the stabilizer box 12 is a receiving chamber 122. A circuit board (not shown in the drawings) is arranged in the receiving chamber 122 and electrically coupled to the heat-conduction pipes 131.

The upper casing 20 is a hood made of a plastic material. The basin 21 is formed on the top of the upper casing 20 and used to receive the heat-conduction pipe frame 10. The basin 21 has a plurality of first through-holes 211 at two sides thereof and a central through-hole 22. Two blocking strips 221 are formed on two inner sides of the central through-hole 22 and used to receive the light concentration plate 40. A rim wall 23 is formed on the other side of the central through-hole 22, and a plurality of structure-enhancing ribs 24 are arranged around the rim wall 23. The head end of the upper casing 20 has a semi-circular hole 200, which is to be inserted through by a power transmission pole (not shown in the drawings). Inside the semi-circular hole 200, there is a plurality of support elements 25 each having a notch 251. Above the support elements 25, there is a fastener 26 having a notch 261. A fastening member 27 having a press-fit hole 271 is used to secure the fastener 26. The tail end of the upper casing 20 has a plurality of fastening rods 28 where one side 291 of a pivotal member 29 is fastened. The upper and lower casings 20 and 30 are pivotally coupled by the pivotal member 29.

Figure 5:
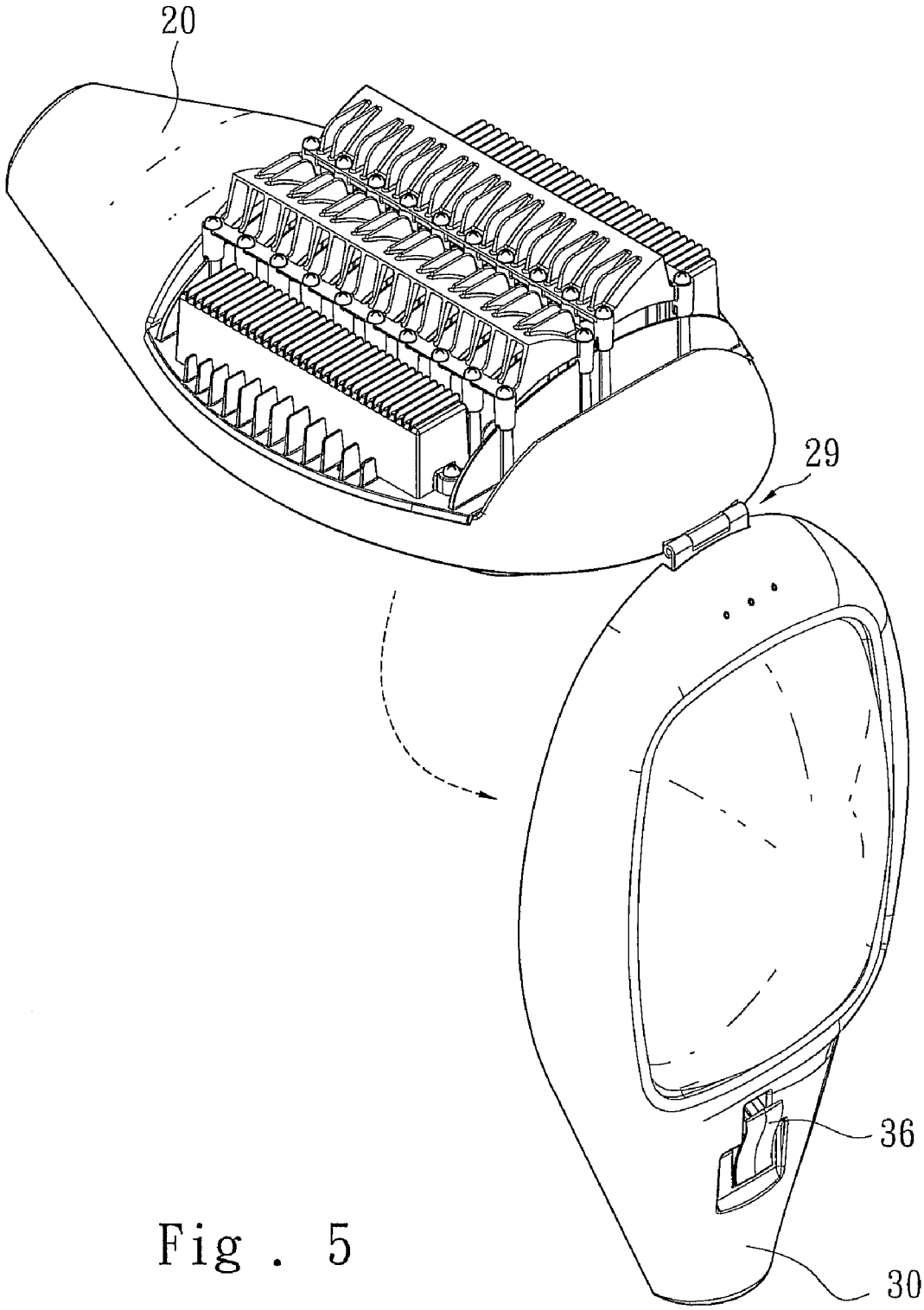
FIG. 5 is a diagram schematically showing that the upper and lower casings according to the present invention are opened.
Figure 6:
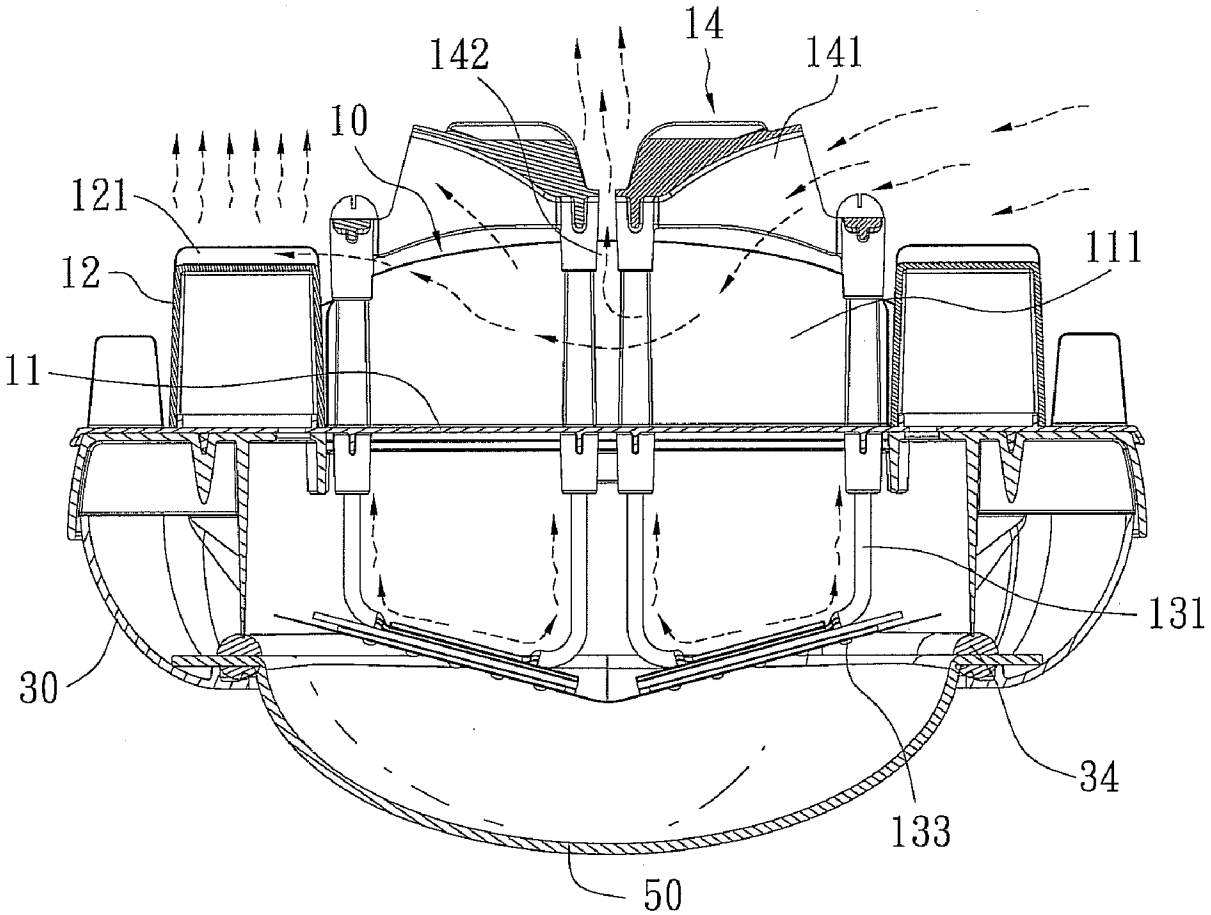
FIG. 6 is a diagram schematically showing heat conduction in an LED streetlight structure according to the present invention.

The lower casing 30 is a hood made of a plastic material. The lower casing 30 has an inclined wall 31 thereinside. The inclined wall 31 is joined to a marginal bottom plate 32, and a concave rim 33 is formed on the marginal bottom plate 32. The concave rim 33 has a plurality of fixing poles 331, and a hole 330 is formed in the center of the concave rim 33. The transparent cover 50 will be arranged in the hole 330, and a water-proof rubber ring 34 is arranged between the transparent cover 50 and the lower casing 30 to make the space therebetween more airtight, as shown in FIG. 6. The head end of the lower casing 30 has a semi-circular hole 300, which is to be inserted through by a power transmission pole (not shown in the drawings). Inside the semi-circular hole 300, there is a press-fit portion 35 having a sleeve member 351, which will sleeve a pin 361 of a press-fit member 36 to form a pivotal relationship between the press-fit member 36 and a press-fit hook 360. The press-fit hook 360 is then press-fitted into the press-fit hole 271 of the fastening member 27. The tail end of the lower casing 30 has a plurality of fastening rods 37 where the other side 292 of the pivotal member 29 is fastened. The upper casing 20 and the lower casing 30 can rotate with respect to the pivotal member 29, as shown in FIG. 5.

The light concentration plate 40 is a curved surface having a plurality of through-holes 41 on two sides thereof. Tow edges of the light concentration plate 40 is secured to the two blocking strips 221 on the inner sides of the upper casing 20.

The transparent cover 50 is a light-permeable cover. The transparent cover 50 has a rim 51 with a plurality of fastening plates 52. The rim 52 will be arranged on and secured to the concave rim 33 of the lower casing 30.

The specification of the ventilation holes 141 of the auxiliary heat-dissipation ventilation device 14 depends on the requirement of heat dissipation.

Figure 2:
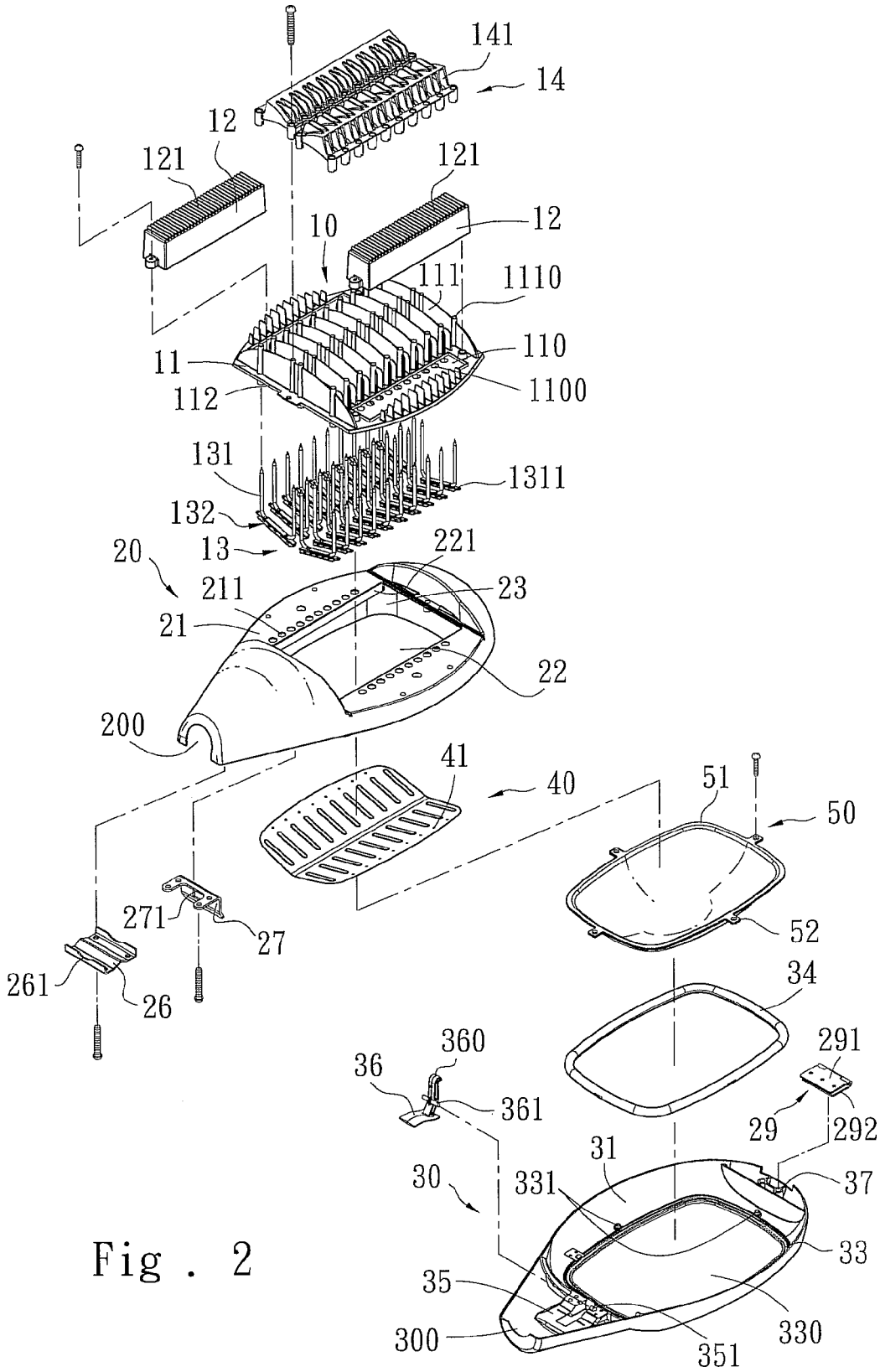
FIG. 2 is an exploded view of an LED streetlight structure according to the present invention.
Figure 3:
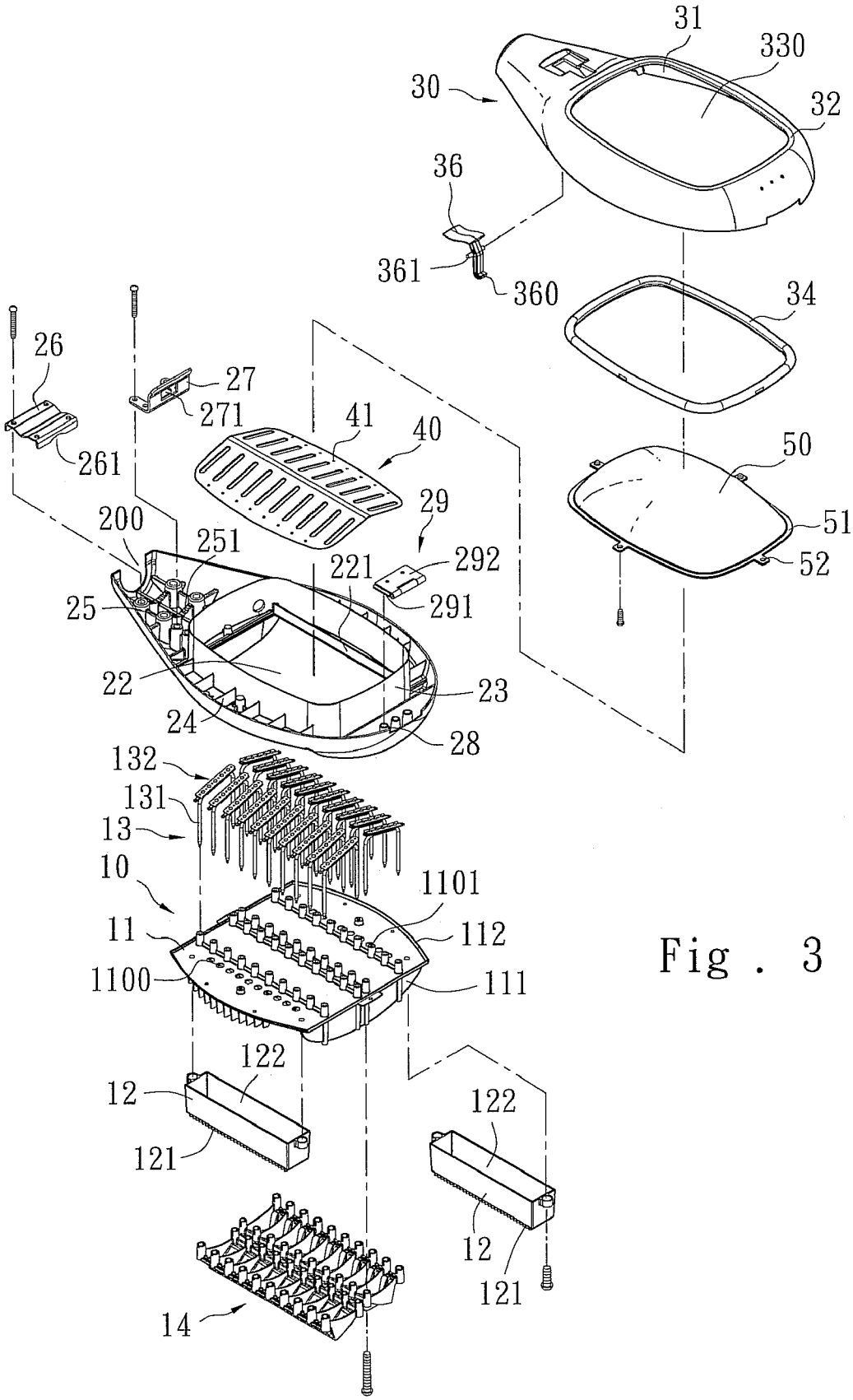
FIG. 3 is another exploded view of an LED streetlight structure according to the present invention.

Refer to FIG. 2 and FIG. 3 again. The heat-dissipation lamp set 13 contains a plurality of heat-conduction pipes 131 and a plurality of LED lamp sets 132. The heat-conduction pipe 131 is a hollow metallic pipe capable of heat conduction. One end of the heat-conduction pipe 131 has two planes 1311 on two sides thereof. The LED lamp set 132 is installed in the plane 1311. The LED lamp set 132 further comprises: a plurality of LED lamps 133, a plurality of heat conduction blocks, a plurality of baseplates and a plurality of fixing elements. The LED lamp set 132 was disclosed in a U.S. patent Ser. No. 12/042,634 and no more repeats herein.

In the present invention, the heat-conduction pipe frame 10 and the upper and lower casings 20 and 30 may be joined together with an adhesion method, and the light concentration plate 40 and the transparent cover 50 can also be joined together with the same way.

Refer to FIG. 2 and FIG. 3 again. In assembling the LED streetlight structure of the present invention, the LED lamps 133 are inlaid into the through-holes of the baseplate to make the electrode-bearing side of the electrode plate of the LED lamps 133 contact the cascade circuit-bearing side of the baseplate. Next, one side of the heat-conduction block is attached to the other side of the electrode plate of the LED lamps 133 so that the heat generated by the LED lamps 133 can be conducted to the heat-conduction block. Next, the fixing elements are inserted through the via-holes of the baseplate and fastened to the fixing holes of the heat-conduction block so that the baseplate and the heat-conduction block can be joined together. Then, the plane 1311 of the heat-conduction pipe 131 is attached to the other side of the heat-conduction block.

Figure 4:
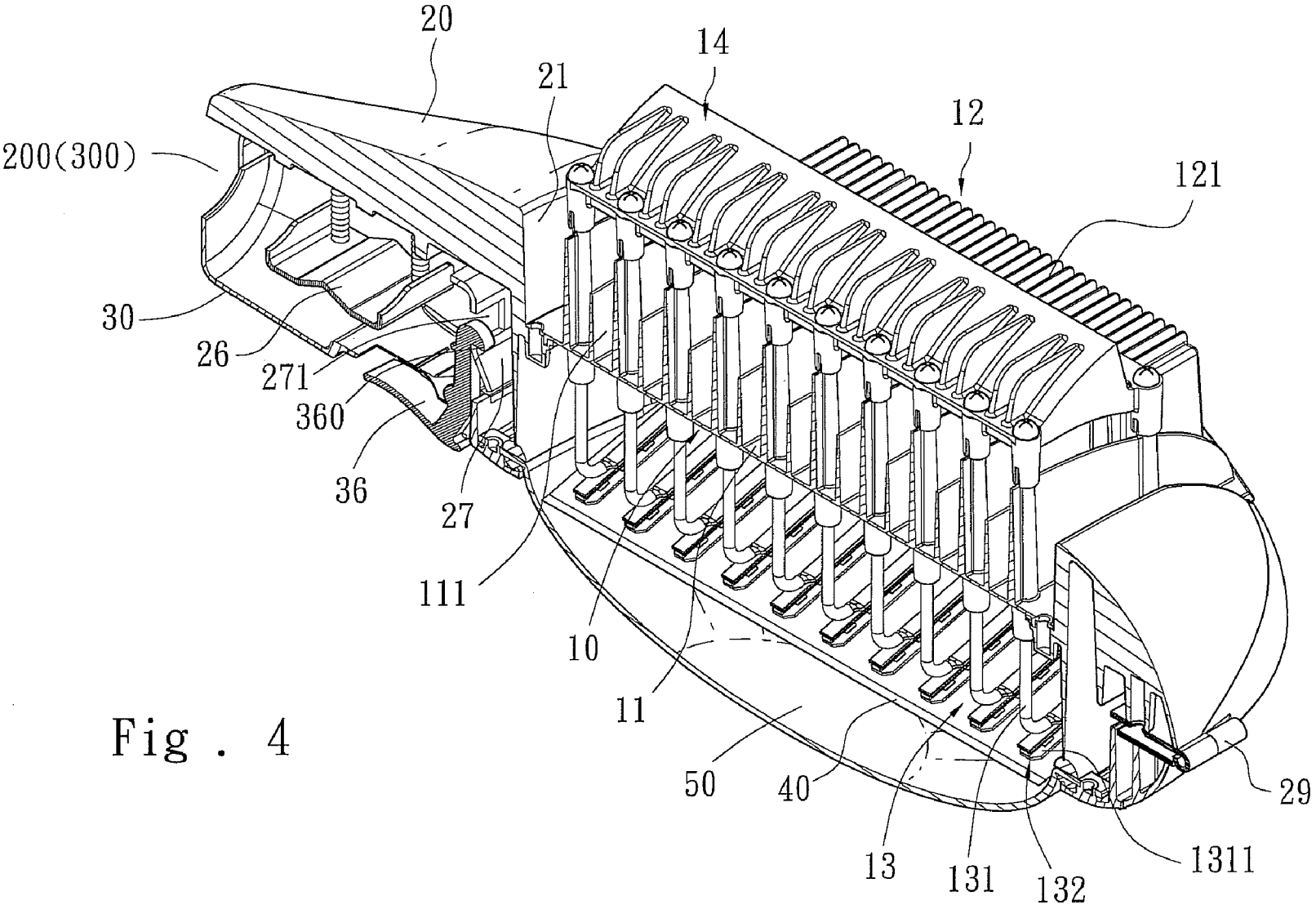
FIG. 4 is a perspective sectional view of an LED streetlight structure according to the present invention.

Refer to FIG. 2 and FIG. 4. After the LED lamp set 132 is assembled to one heat-conduction pipe 131, another heat-conduction pipe 131 is taken to overlap the other plane 1311 of the original heat-conduction pipe 131 to increase the heat dissipation effect of the entire heat-dissipation lamp set 13. Next, the heat-dissipation lamp set 13 is inserted into one side of the heat-dissipation seat 11. Next, the stabilizer boxes 12 with the fins 121 are installed in two sides of the heat-dissipation seat 11, and the auxiliary heat-dissipation ventilation device 14 is installed on the heat-dissipation seat 11. Next, the heat-conduction pipe frame 10 is secured to the basin 21 of the upper casing 20. Next, two sides of the light concentration plate 40 are secured to the blocking strips 221. Next, the water-proof rubber ring 34 is arranged between the transparent cover 50 and the concave rim 33 of the lower casing 30. Next, the transparent cover 50 is secured to the fixing poles 331 of the lower casing 30 with fastening elements. Next, the tail ends of the upper and lower casings 20 and 30 are pivotally coupled to each other via the pivotal member 29. Next, the press-fit hook 360 of the press-fit member 36 of the lower casing 30 is press-fitted into the press-fit hole 271 of the fastening member 27 of the upper casing 20. Then is completed the assemblage of the LED streetlight structure of the present invention. Refer to FIG. 4 and FIG. 5. When the internal component of the LED streetlight is to be replaced, the press-fit state between the press-fit hole 271 and the press-fit member 36 is firstly released via pulling the press-fit member 36. Then, the lower casing 30 will rotate downward with the pivotal member 29 being a pivotal axis, and a 90 degree opening is formed between the upper and lower casings 20 and 30. Thus, the personnel can undertake maintenance easily.

In using the LED streetlight structure of the present invention, heat generated by the LED lamps 133 will be conducted to the main heat-dissipation fins 111 by the heat-conduction pipes 131 and dissipated therefrom. The auxiliary heat-dissipation ventilation device 14 is made of aluminum, and aluminum itself benefits heat dissipation. Further, air can be compulsively conducted to the main heat-dissipation fins 111 via the ventilation holes 141 on one side of the auxiliary heat-dissipation ventilation device 14. The air will take away heat from the main heat-dissipation fins 111 and then go out from the ventilation holes 141 on other side and the central heat-dissipation hole 142. Besides, the air will brush through the stabilizer boxes 12 and take away heat from the fins 121 on the stabilizer boxes 12.

In conclusion, the present invention installs the main heat-dissipation fins 111 on the heat-conduction pipe frame 10 and installs the fins 121 on the stabilizer boxes 12 to increase heat-dissipation area. The aluminum material of the auxiliary heat-dissipation ventilation device 14 also benefits heat dissipation. Further, air can be compulsively conducted to the main heat-dissipation fins 111 via the ventilation holes 141 on one side of the auxiliary heat-dissipation ventilation device 14, and the air will take away heat from the main heat-dissipation fins 111 and then go out from the ventilation holes 141 on other side and the central heat-dissipation hole 142. Furthermore, the air will brush through the stabilizer boxes 12 and take away heat from the fins 121 on the stabilizer boxes 12. Thereby, the present invention can enhance the heat dissipation effect and prolong the lifetime of the LED lamps 133.

What is claimed is:

1. A light emitting diode (LED) streetlight structure comprising:

a heat-conduction pipe frame, further comprising: a heat-dissipation seat having main heat-dissipation fins and two interspaces at two sides thereof, wherein said interspace has a plurality of insertion rods; two stabilizer boxes, respectively secured in said two interspaces; a plurality of heat-dissipation lamp sets having a plurality of heat-conduction pipes inserting into said insertion rods; and an auxiliary heat-dissipation ventilation device, arranged above said insertion rods and having a plurality of ventilation holes at two sides thereof and a central heat-dissipation hole;

an upper casing, having a basin formed on the top thereof and used to receive said heat-conduction pipe frame, wherein said basin has a plurality of first through-holes at two sides thereof and a central through-hole, wherein two blocking strips are formed on two inner sides of said central through-hole, and a pivotal member is installed in the tail end of said upper casing;

a lower casing, having an inclined wall thereinside, wherein said inclined wall is joined to a marginal bottom plate, and a concave rim is formed on said marginal bottom plate, and wherein a water-proof rubber ring is arranged between a transparent cover and said lower casing to make the space therebetween more airtight, and wherein said pivotal member is installed in the tail end of said lower casing, and said upper casing and said lower casing are pivotally coupled to each other by said pivotal member;

a light concentration plate with two edges thereof secured to said two blocking strips on the inner sides of said upper casing; and the transparent cover, having a rim secured to said concave rim of said lower casing.

2. The light emitting diode streetlight structure according to claim 1, wherein said interspace has a plurality of insertion holes.

3. The light emitting diode streetlight structure according to claim 1, wherein said upper casing and said lower casing are made of a plastic material.

4. The light emitting diode streetlight structure according to claim 1, wherein each said stabilizer box has a plurality of fins on the top thereof and a receiving chamber in the bottom thereof.

5. The light emitting diode streetlight structure according to claim 1, wherein the specification of said ventilation holes at two sides of said auxiliary heat-dissipation ventilation device depends on the requirement of heat dissipation.

* * * * *